US010196819B2

(12) United States Patent
Miedzik et al.

(10) Patent No.: US 10,196,819 B2
(45) Date of Patent: Feb. 5, 2019

(54) MODULE FOR THE PRODUCTION OF CONCRETE PARTS, DISPLACEMENT BODY, USE OF A GRID FOR THE PRODUCTION OF A MODULE AND CONCRETE PART

(71) Applicant: HEINZE GRUPPE VERWALTUNGS GMBH, Herford (DE)

(72) Inventors: Georg Miedzik, Hittnau (CH); Hugo Meier, Neuhausen am Rheinfall (CH)

(73) Assignee: Heinze Gruppe Verwaltungs GmbH, Herford (DE)

( * ) Notice: Subject to any disclaimer, the term of this patent is extended or adjusted under 35 U.S.C. 154(b) by 0 days.

(21) Appl. No.: 15/543,370

(22) PCT Filed: Jan. 14, 2016

(86) PCT No.: PCT/EP2016/050611

§ 371 (c)(1),
(2) Date: Jul. 13, 2017

(87) PCT Pub. No.: WO2016/113326

PCT Pub. Date: Jul. 21, 2016

(65) Prior Publication Data

US 2018/0002930 A1 Jan. 4, 2018

(30) Foreign Application Priority Data

Jan. 16, 2015 (EP) ..... 15405004

(51) Int. Cl.
*E04C 5/06* (2006.01)
*E04B 5/32* (2006.01)
(Continued)

(52) U.S. Cl.
CPC ..... *E04C 5/0622* (2013.01); *E04B 5/328* (2013.01); *E04B 9/0457* (2013.01); *E04C 5/20* (2013.01); *E04C 5/064* (2013.01)

(58) Field of Classification Search
CPC ..... E04B 5/328; E04B 9/0457; E04C 5/20; E04C 5/0622
See application file for complete search history.

(56) References Cited

U.S. PATENT DOCUMENTS 4,702,048 A * 10/1987 Millman ..... E04B 2/84 249/13
5,797,230 A * 8/1998 Lassen ..... E04B 5/326 52/320

(Continued)

FOREIGN PATENT DOCUMENTS

EP 2 075 387 7/2009
JP 2009191542 A * 8/2009 ..... E04B 5/328

*Primary Examiner* — Michael Safavi
(74) *Attorney, Agent, or Firm* — Collard & Roe, P.C.

(57) ABSTRACT

A module for the production of concrete parts has a row of displacement bodies that are adjacently arranged in a horizontal longitudinal direction (L) and that are clamped captively to a grid structure made of at least two individual grids running in the longitudinal direction (L). Surfaces of the grids are oriented in a transverse or inclined manner in relation to the horizontal. Each of the grids has at least a first and a second longitudinal bar arranged at a distance in parallel to one another and running in the longitudinal direction (L) and a plurality of transverse bars being arranged at a distance from one another and oriented in a transverse or inclined manner in relation to the horizontal. The transverse bars are respectively connected with the longitudinal bars. One of the displacement bodies for each grid has a first and a second retaining device.

17 Claims, 4 Drawing Sheets

Figure 1:
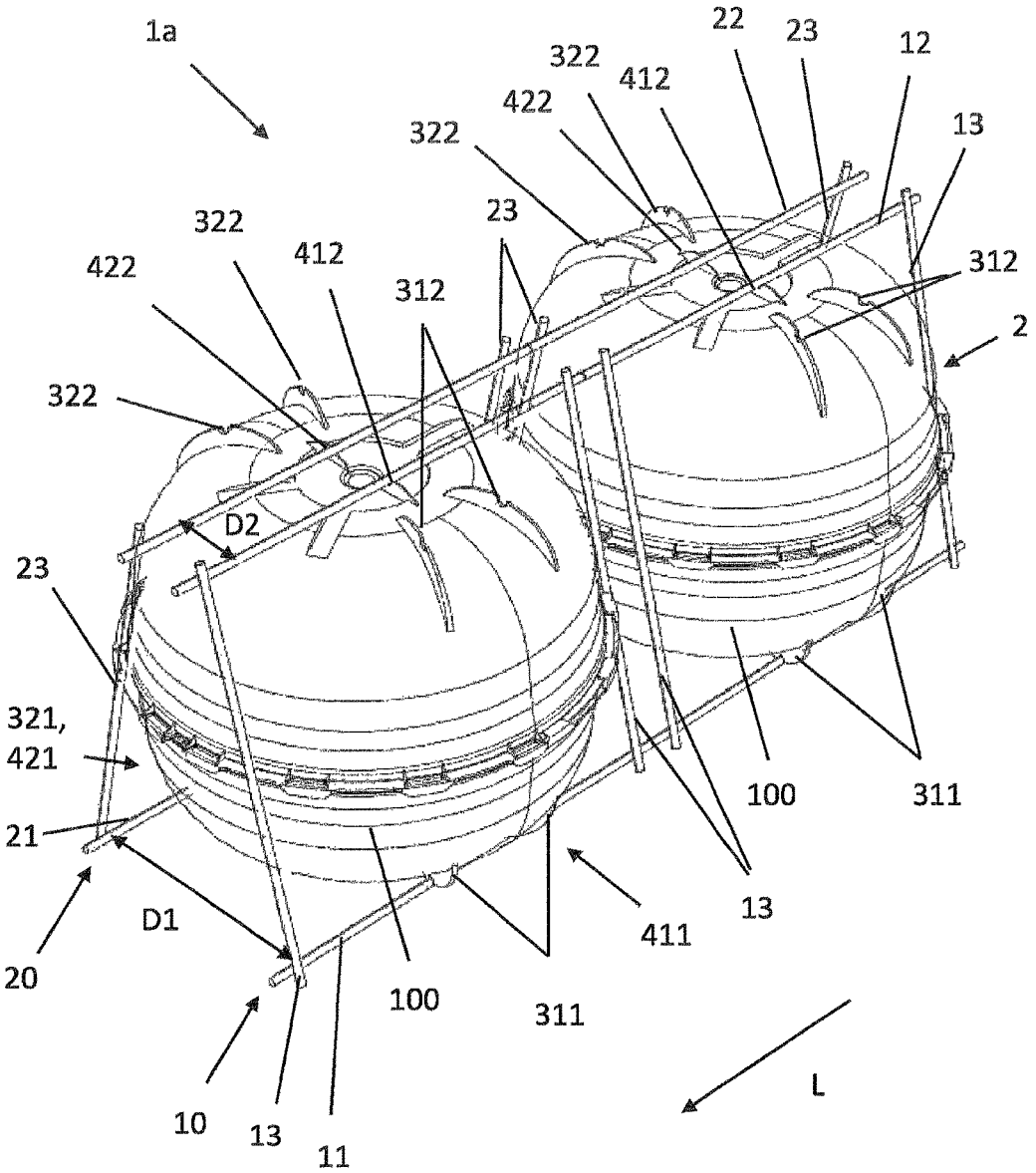

(51) Int. Cl.
*E04B 9/04* (2006.01)
*E04C 5/20* (2006.01)

(56) References Cited

U.S. PATENT DOCUMENTS

| | | | | |
|---|---|---|---|---|
| 6,205,737 | B1 * | 3/2001 | Haussler | E04B 5/326 52/649.1 |
| 6,550,207 | B1 * | 4/2003 | Pontarolo | E04B 5/21 52/437 |
| 7,540,121 | B2 * | 6/2009 | Haeussler | E04C 5/0645 52/323 |
| 8,028,485 | B2 * | 10/2011 | Pfeffer | E04B 5/328 52/576 |
| 9,038,352 | B2 * | 5/2015 | Miedzik | E04B 5/328 52/745.13 |
| 2005/0011152 | A1 * | 1/2005 | O'Grady | E04G 9/08 52/364 |
| 2007/0214740 | A1 * | 9/2007 | O'Grady | E04B 5/21 52/577 |
| 2012/0200004 | A1 | 8/2012 | Levinton | |
| 2013/0212974 | A1 | 8/2013 | Sullivan | |

* cited by examiner

MODULE FOR THE PRODUCTION OF CONCRETE PARTS, DISPLACEMENT BODY, USE OF A GRID FOR THE PRODUCTION OF A MODULE AND CONCRETE PART

CROSS-REFERENCE TO A RELATED APPLICATION

The invention described and claimed hereinbelow is a National Stage Application of PCT/EP2016/050611, filed on Jan. 14, 2016 (the PCT application), now filed in the United States under 35 USC § 371. The PCT application claims priority from European Patent Application EP 15405004.1, filed on Jan. 16, 2015. The contents of the PCT application and the European Patent Application are incorporated by reference herein, and provide the basis for a claim for priority of invention.

BACKGROUND OF THE INVENTION

The invention relates to a module for the production of concrete parts, both using the in-situ concrete method and in the prefabrication plant, which comprises at least one row of a plurality of displacement bodies being adjacently arranged in a longitudinal direction, which are captively arranged in a three-dimensional grid structure of bars, a displacement body, a use of a grid for the production of a module and a concrete part.

Such displacement body modules are generally known from the prior art, which are cast in concrete layers or concrete parts to make them lighter and more cost-effective. For the production of modules, the displacement bodies are typically used in gridded baskets, which make the concrete element to be produced more stable at the same time. For this purpose, the bars of the gridded baskets are usually made of steel, specifically reinforcing steel.

For example, such a module is known from EP 2075387 A1, which comprises an elongated, trough-shaped gridded basket being U-shaped or trapezoidal in its cross-section, which consists of four longitudinal bars running in the longitudinal direction and substantially U-shaped or trapezoidal cross bar brackets being arranged vertical to this. The longitudinal bars and cross bar brackets are interconnected and together form the grid structure receiving the displacement bodies. The cross bar brackets are arranged such on the longitudinal bars that each two respectively adjacent cross bar brackets together with the longitudinal bars each define a receiving space for one displacement bodies. The receiving space is designed such that it surrounds or fixes the displacement body to the effect that any raising or slipping of the displacement body within the receiving space can be substantially avoided. The gridded basket can generally cover almost any size. The displacement bodies can each be inserted respectively into the relevant receiving space by temporarily widening both bracket sides of the flexible gridded basket being U-shaped or trapezoidal in the cross-section beyond its open base side being downwardly facing in the subsequent installation state.

For the production of a concrete part, for example a concrete ceiling, one or a plurality of these modules are initially positioned in parallel on reinforcement steel supports, for example on a reinforcement steel mesh, which are in turn arranged over a cladding. Further reinforcement steel supports are then typically arranged on the modules and the entire construct is then filled with concrete. The filling can also occur gradually or in layers during the assembly of the entire construction of reinforcement steel supports and modules.

The assembly of the modules known from EP 2075387 A1 typically occurs on the building site, wherein specifically the gridded bodies are normally supplied to the building site as prefabricated parts. The prefabricated, trough-shaped gridded baskets can be stacked into each other. Due to their bulky shape, the gridded baskets still require a great deal of transport capacity despite the stackability. In addition, the preliminary step of the in-mould bending of the U-shaped or trapezoidal cross bar brackets and the subsequent connection, specifically welding, of the cross bar brackets with the longitudinal bars make the production of such gridded baskets very laborious.

US 2012/0200004 A1 discloses a weight-reduced ceiling construction, in which displacement bodies are positioned between a lower and an upper horizontally aligned grid made of reinforcing steel. The two grids are then connected together by means of hooks before the casting of concrete occurs. Each displacement body comprises on the upper side and lower side a ring made of projecting annular segments, which are inserted into an opening of a grid with clearance. The delivery and positioning of the horizontal grids is laborious and can only be carried out by a plurality of people on a large surface.

Furthermore, US 2013/0212974 A1 discloses a concrete casting method for the production of concrete parts using plastic inclusion bodies. These inclusion bodies can also be positioned between two horizontal steel grids, wherein hollow bodies can also be optionally positioned between the steel grids. The steel grids have a high dead weight and can therefore only be processed with difficulty. In addition, the steel grids are only available in predefined sizes such that the alignment and assembly is comparatively complicated.

OBJECTS AND SUMMARY OF THE INVENTION

The object of the invention therefore is to specify an improved module for the production of concrete parts, through which the grid structure can be both simply and cost-effectively produced and also transported with the lowest possible transport capacities and with a minimal logistical effort.

The core of the invention is to replace the bulky and costly-to-produce gridded baskets with a grid structure, which consists only of at least two individual, preferably flat grids, which correspond to the two bracket sides of the gridded baskets known from the prior art and which can be combined simply with all the displacement bodies being arranged at least in a parallel row such that all displacement bodies are substantially clamped together captively by the two laterally flanking grids as a composite.

According to the invention, it is provided that the grid structure is formed from at least two individual grids running in the longitudinal direction, whose grid surfaces are oriented in a transverse or inclined manner in relation to the horizontal and which respectively comprise at least one first and one second longitudinal bar being arranged at a distance in parallel to one another and running in the longitudinal direction and a plurality of transverse bars being spaced apart and oriented in a transverse or inclined manner in relation to the horizontal, which are each connected with the longitudinal bars, specifically welded.

To connect the grids to displacement bodies, it is provided according to a first inventive solution for at least single-row modules that at least one of the displacement bodies in the one row comprises respectively at least one first and at least one second retaining device on its outer side for each grid, said retaining devices being formed and arranged in relation to one another in such a way that both respective grids are at least interlockingly and captively secured between the first and second retaining device, by accommodating the first longitudinal bar in the first retaining device and accommodating the second longitudinal bar in the second retaining device, and thereby holding together all displacement bodies. In this regard, it is sufficient that the grid with the at least one first and second longitudinal bar is secured to at least one displacement body, while the other displacement bodies in the row are substantially held together by clamp-like means only by the two grids of the at least one first and second longitudinal bar and the plurality of transverse bars, but not necessarily connected with these bars by means of a retaining device.

To increase the stability of the composite of the two grids and the entirety of the adjacently arranged displacement bodies, it is provided according to an advantageous embodiment of the invention that a plurality of displacement bodies, specifically every second displacement body, preferably all displacement bodies in the row comprise for at least one of the grids, preferably for both grids, respectively at least one first and one second retaining device for accommodating the respective first or second longitudinal bar.

Since according to the invention the grid structure is formed from only two individual grids, the demanded transport capacities and logistical effort to supply the grid structure or its components from the supplier or producer to the building site is greatly reduced, thereby increasing the modularity as a whole. This is because individual grids, specifically if they are substantially flat, can be stacked in a considerably space-saving manner and can therefore be transported with considerably more efficiency. Secondly, the individual grids, specifically if these are substantially flat, can be produced with considerably less labour effort and costs. The at least two individual grids are therefore preferably formed in a substantially flat form and comprise straight longitudinal bars and straight transverse bars.

A further disadvantage of the prefabricated gridded baskets known from the prior art is that they do not permit the multilayer arrangement of modules, which each consist respectively of an individual row of displacement bodies enclosed into a basket. The decisive factor here is that a construction of a plurality of stacked gridded baskets being filled with displacement bodies comprises no vertically continuous transverse bars having a disadvantageous effect on the statics of the reinforcement and therefore mostly not corresponding to the required structural requirements. On the other hand, the inventive core idea, namely replacing the gridded baskets by a grid structure consisting only of at least two individual, preferably flat grids, allows both grids to be easily extended in the vertical direction over a plurality of stacked rows of adjacently arranged displacement bodies. Thus, the inventive core idea can also be used to realise a multi-row module consisting of a plurality of stacked rows of a plurality of displacement bodies being adjacently arranged in a horizontal longitudinal direction and specifically for the production of thicker concrete parts.

Therefore, an inventive solution for multi-row modules according to claim 3 consists of the grid structure also being formed from at least two individual grids running in the longitudinal direction, whose grid surfaces are oriented in a transverse or inclined manner in relation to the horizontal, wherein each of the grids in turn comprises at least one first and one second longitudinal bar being arranged at a distance in parallel to one another and running in the longitudinal direction and a plurality of transverse bars being spaced apart and oriented in a transverse or inclined manner in relation to the horizontal, which are each connected respectively with the longitudinal bars, specifically welded. In order to achieve the composite of the entirety of all displacement bodies with the two grids according to this solution, it is provided that at least one of the displacement bodies in the bottom row comprises respectively at least one first retaining device on its outer side for each grid and at least one of the displacement bodies in the top row comprises respectively at least a second retaining device on its outer side. As such, the first and second retaining devices are formed and arranged in relation to one another in such a way that both respective grids are at least interlockingly and captively secured between the first and second retaining device, by accommodating the first longitudinal bar in the first retaining device and accommodating the second longitudinal bar in the second retaining device, and thereby holding together all displacement bodies. In this regard, it is also sufficient that the other displacement bodies in the top and bottom row and the displacement bodies of any other rows, which are not directly connected with the longitudinal bars of the grid by a retaining device, are only held together by the two grids of the at least one first and second longitudinal bars and the plurality of transverse bars.

With the solution for multi-row modules, the two grids can also be produced simply and cost-effectively and can also be transported with a low transport capacity demand and minimal logistical effort. The at least two individual grids are preferably in turn formed in a substantially flat form and comprise straight longitudinal bars and straight transverse bars. The connection of the grids to the entirety of the displacement bodies for multi-row modules according to claim 3 differs to the inventive solution according to claim 1 thus that in the latter at least one displacement body for each grid comprises respectively both a first retaining device and also a second retaining device in order to at least interlockingly and captively secure each grid to a single displacement body, while all other displacement bodies are substantially held by both grids. In comparison, it can be sufficient with multi-row modules for a stable and captive composite if the grid is secured between two displacement bodies in the top and in the bottom row, while the remaining displacement bodies are only held together by the grid structure.

According to an advantageous embodiment of the module according to claim 3, it can be provided in the sense of an increased cohesion of the composite that a plurality, specifically every second, preferably all displacement bodies in the bottom row comprise at least a first retaining device for the first longitudinal bar of at least one of the grids, preferably all grids. Alternatively or additionally, a plurality, specifically every second, preferably all displacement bodies in the top row can respectively comprise at least a second retaining device for the second longitudinal bar of at least one of the grids, preferably all grids. Naturally, in a further advantageous embodiment of the module according to claim 3, at least one displacement body can be provided with a first or second retaining device for at least one of the grids in at least one further row. For this purpose, the grid preferably comprises a further first or second longitudinal bar. It is naturally also possible that in at least one of the rows of the module according to claim 3 such displacement bodies are used comprising both a first and a second retaining device for at least one of the grids or both grids—as with the module according to claim 1. If such a displacement body with at least a first and second retaining device for at least one of the grids in a row is used for a module according to claim 3, then the respective grid for this row can preferably comprise a first and second or where applicable an additional first or second longitudinal bar.

According to a particularly preferred embodiment of the invention, each of the displacement bodies comprises at least a first and a second retaining device for both respective grids. Such a displacement body can be advantageously used universally for both single-row and multi-row modules.

The term "first" and "second" longitudinal bar relates to the determination of the relevant longitudinal bar being accommodated in a first or second retaining device. The term "first" and "second" retaining device in turn relates generally to the fact that at least generally two complementary or cooperative retaining devices are provided to secure a grid being at least interlockingly and captively secured between said retaining devices. With a single-row module, the cooperative first and second retaining devices are arranged on a single displacement body, whereas with a multi-row module the cooperative first and second retaining devices can each be arranged respectively on different displacement bodies in different rows, preferably the bottom and top row. However, irrespective of the number of rows, i.e. both for single-row and dual-row modules, each first retaining device can also generally interact with one or a plurality of further second retaining devices, which are either arranged on the same displacement body or on a different displacement body of the same or of another row. The same applies in reverse for the second retaining devices.

To further increase the stability of the composite between the entirety of all displacement bodies and the grids, it can be provided according to an advantageous embodiment of the invention that at least one displacement body respectively comprises a plurality of longitudinally extending, adjacently arranged first retaining devices and/or respectively a plurality of longitudinally extending, adjacently arranged second retaining devices, in which the respective first or second longitudinal bar is simultaneously accommodated. As such, the respective bar is secured to at least two retaining devices in the sense of a multi-point fixation to a single displacement body.

For optional securing of at least one of the grids transversely or inclined towards the horizontal in various positions, in which the grid surface is arranged towards the vertical at an angle of between 0° and less than 90°, preferably 0° to 30°, the one or plurality of displacement bodies can respectively comprise a plurality of first and/or a plurality of second retaining devices, which are arranged offset to one another transversely to the longitudinal direction. The offset arrangement transversely to the longitudinal direction between the plurality of first or between the plurality of second retaining devices can specifically be aligned exclusively vertical to the longitudinal direction or additionally comprise a component in the longitudinal direction as well. The plurality of first or second retaining devices being offset to each other transversely to the longitudinal direction can be specifically different in the manner of their formation or formed similarly.

According to a further advantageous embodiment of the invention, at least one of the first and/or second retaining devices is formed as a locking device, preferably as a locking hook, locking recess, locking nut, locking groove or locking clamp. Specifically, the respectively cooperative first and second retaining devices can be formed and arranged complementary such that the grid secured between them is captively attached to the entirety of the displacement bodies only due to the cooperation of the first and second retaining device. This can for example be achieved in that the grid is fixed between the at least one first and second retaining device by inserting the respective first and second longitudinal bar, for example through temporary flexible deformation of the first and second retaining device being for example formed as locking nuts or locking grooves and being arranged immobile relative to each other. For multi-row modules, the individual displacement bodies are supported by one another such that they can as a composite accommodate the counterforce caused by the fixing of the grid such that the assembled module of displacement bodies and grids is held together in a generally stable manner. For multi-row modules, support elements, specifically support rings, which act as centering rings, can be arranged in the sense of a reinforcement of the composite between adjacent rows, specifically between each two stacked displacement bodies of adjacent rows. An individual longitudinal bar accommodated in the relevant retaining device or a single grid accommodated on its own in the first or second retaining device must not necessarily be captively secured. Of course, the at least one first and/or second retaining device can also be formed, specifically as locking devices, such that an individual bar is already captively secured through accommodation in the relevant retaining device. For this purpose, the relevant retaining device can be formed as a locking clamp or clip-like locking device for example.

According to a further embodiment of the invention, at least one of the first and/or second retaining devices can comprise a nut or groove-like recess running in the longitudinal direction, into which a corresponding longitudinal bar can be inserted where applicable by means of temporary flexible deformation. The nut or groove-like recess shall preferably comprise a contorted, specifically circle segment-shaped cross-sectional profile line, which is preferably adjusted to the radius of the longitudinal bars. The assembly of the module can be significantly simplified by this advantageous embodiment. For example, in a single-row module, the at least one or the plurality of first retaining devices can be formed as longitudinal nuts or grooves with circle segment-shaped profiles, into which the first longitudinal bar is initially inserted, in the simplest case. Due to the circle segment-shaped profile, the first retaining device(s) can serve as a pivoting bearing for the grid at the same time, such that the grid with its second longitudinal bar can hereinafter be inserted into the second retaining device(s) by means of a simple pivoting movement around the longitudinal axis of the first longitudinal bar being accommodated in the first retaining device(s). The same is also applicable to multi-row modules, for which the first retaining device(s) can for example be formed in the bottom row as longitudinal n or grooves with circle segment-shaped profiles.

According to a further embodiment of the invention, the retaining devices, specifically the nut or groove-like recess, can be formed in a web extension on the outer surface of the displacement body, which preferably extends transversely to the longitudinal direction. Such a web extension can on the one hand act as a reinforcing rib for a displacement body being formed specifically as a closed or partially open hollow body. On the other hand, the web extensions can serve to comply with the overages structurally required under certain circumstances (layer thickness of the concrete between reinforcement steel supports and displacement bodies arranged thereon and thereunder) through the web extension being used to enlarge the interval between displacement body and longitudinal bar, to which the reinforcement steel supports are typically fitted directly.

According to a further embodiment of the invention with at least one displacement body, the one or plurality of first retaining devices can be arranged on the lower side and/or the one or plurality of second retaining devices can be arranged on the upper side of the displacement body for this purpose among other things. The displacement bodies are preferably formed substantially as oblate spheroids with oblate upper and lower sides, whereby flat concrete parts can specifically be produced. In addition, it can be provided that with at least one displacement body the at least one second retaining device for the one grid and the at least one second retaining device for the other grid are arranged together such that the interval between the respectively accommodated second longitudinal bars does not exceed 75 mm, specifically does not exceed 60 mm, preferably does not exceed 50 mm. For single-row modules and for the top row of multi-row modules, this effects that the module is accessible at both upper, second longitudinal bars of both grids when producing a concrete part, without there existing the risk that a person steps with their foot directly onto the displacement body between the longitudinal bars. Specifically displacement bodies formed as fragile hollow bodies are incorporated into the grid structure in a safely accessible manner insofar as the weight of a person standing on the module is primarily deflected through the grid structure to the underneath. To ensure a secure position of the module on the reinforcement arranged below, it can be provided in a further advantageous embodiment of the invention that the at least one first retaining device for the one grid and the at least one first retaining device for the other grid, for multi-row modules specifically in the bottom row, are arranged together such that the interval between the respectively accommodated first longitudinal bars is at least 75 mm, at least 150 mm, preferably 185 mm.

According to an advantageous and particularly cost-effectively producible embodiment of the invention, at least one of the first and/or second retaining devices, preferably all retaining devices, are formed as a single piece with the relevant displacement body. To assemble the displacement bodies as quickly as possible to a module and to provide in this respect a plurality of possible mounting directions, which avoid elaborate rotating and positioning of the displacement body in the correct mounting direction, at least one of the displacement bodies, preferably all displacement bodies, can be formed parallel to the longitudinal direction relative to a vertical level and/or mirror-symmetrically relative to a horizontal level. As already mentioned, at least one of the displacement bodies is advantageously formed as a hollow body or preferably all displacement bodies are formed as hollow bodies. The hollow body can either be formed as a closed hollow body or as partially open hollow body with the opening downwardly facing into the module. Specifically, spheres, spheroids, hemispheres or dome-shaped shells are conceivable. In addition, at least one, preferably all displacement bodies can consist of two half-body elements, specifically two half-shell elements. The half-part or half-shell design means that the half shells can be stacked space-savingly into or onto one another such that only a lower transportation volume arises, whereby transportation capacities can be better utilised and considerable costs can be saved. In addition, the half-body elements or half-shell elements can be identical such that no different, complementary element is required to produce a displacement body from this element, but in turn only exactly the same element. Consequently, confusions are excluded as well as the possibility that a diverging number of respectively complementary elements may be delivered onto a building site. The latter can lead specifically then to considerable delay and thus to additional costs, if the elements must be transported by sea over long distances, such as from Europe to Asia. Preferably, the displacement bodies are made of plastic and/or are formed as a plastic injection part.

According to a further advantageous embodiment of the invention, it is provided that each at least one transverse bar extends between each two adjacent displacement bodies in a row at least sectionally and/or that each displacement body in the longitudinal direction is arranged between each two transverse bars, which are fitted specifically to the displacement body, preferably such that the transverse bars secure the displacement bodies against adjustment along the longitudinal direction and to the side. Collectively, each two respective pairs of transverse bars together with the at least one first and second longitudinal bar thus define a receiving space for a displacement body or a column of displacement bodies, which surrounds or fixes the displacement body or bodies to the effect that any raising or slipping of the displacement body within the receiving space can be substantially avoided. The transverse bars also prevent the connection between the two half-shell elements accidently being loosened with a displacement body composed of two half shells. If the displacement body consists for example of two half-shell elements, which are connected through a slide closure through lateral telescoping of the two half-shell elements parallel to the shared contact level, then such a displacement body is preferably arranged in the module such that the effective direction of the slide closure is arranged parallel to the longitudinal direction of the module such that inadvertent opening of the slide closure is prevented by the transverse bars.

The longitudinal bars and/or transverse bars preferably consist of steel, specifically of reinforcing steel. In addition, all longitudinal bars and/or transverse bars comprise the same diameter.

Furthermore, the invention relates to a displacement body for use in a module of the above described manner, which comprises respectively at least one first and/or at least one second retaining device on its outer side for each grid of the module. In addition, the invention relates to a grid for use in a module of the afore described manner with at least two spaced longitudinal bars running parallel to each other in a longitudinal direction and a plurality of spaced transverse bars aligned transversely to the longitudinal direction, which are connected respectively with both longitudinal bars. Finally, the invention relates to a concrete part, specifically a concrete ceiling, produced using at least one module of the aforementioned manner.

BRIEF DESCRIPTION OF THE DRAWING FIGURES

Figure 2:
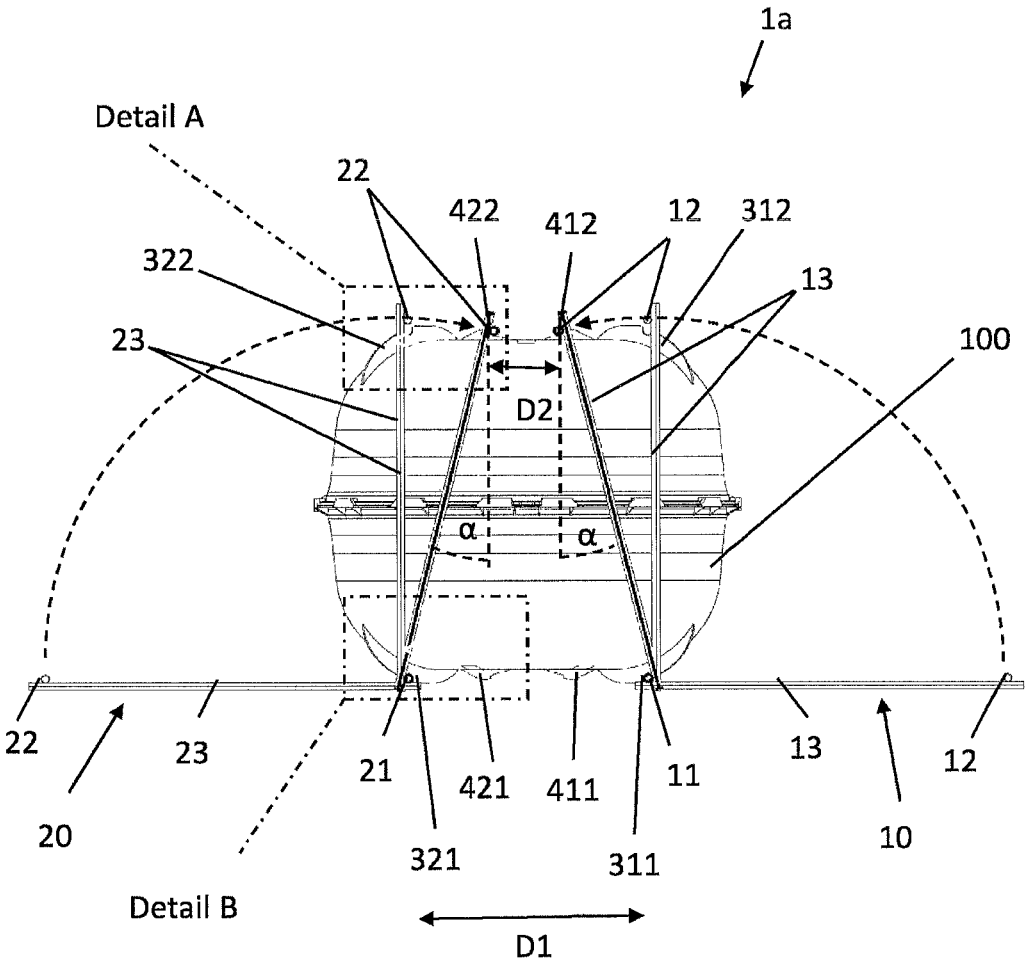
Figure 3:
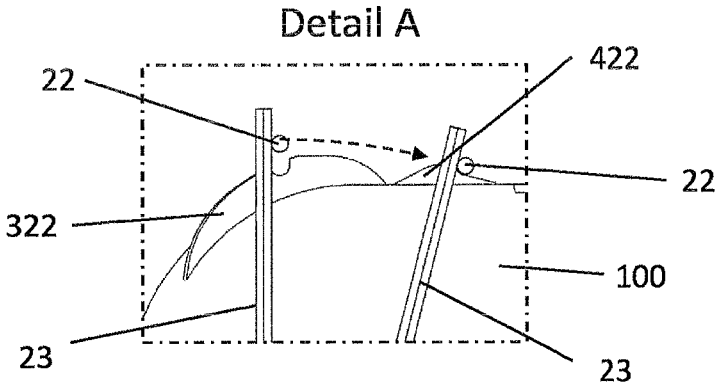
Figure 4:
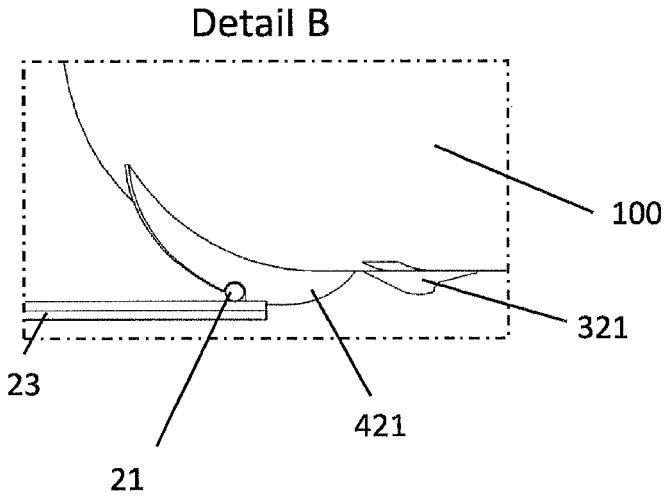
Figure 5:
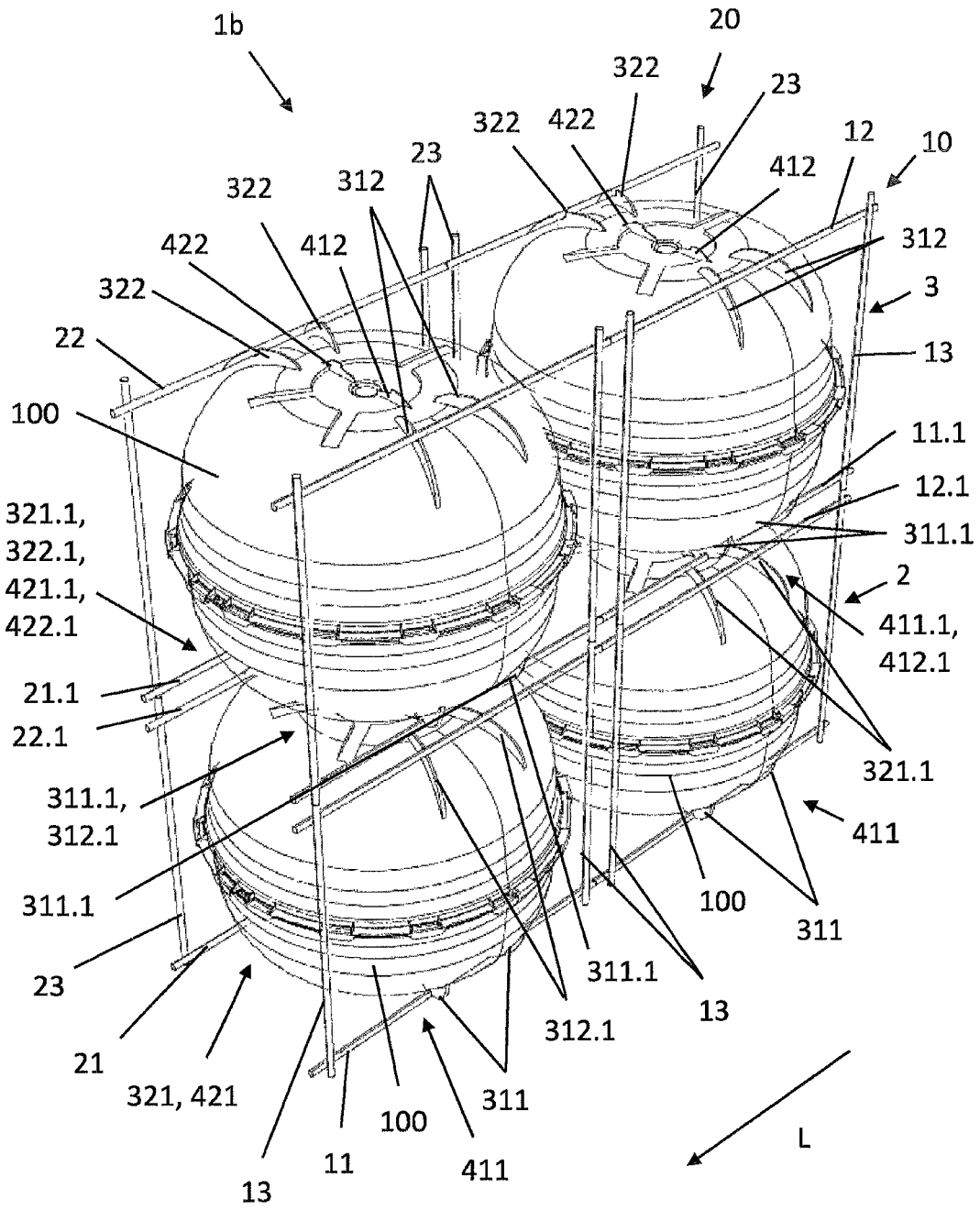

Further aims, advantages and possible uses of the present invention will become apparent from the following description of an exemplary embodiment based on the drawings. In the drawings:

FIG. 1 shows a perspective view of a possible exemplary embodiment of a single-row module as per the invention for the production of a concrete part, FIG. 2 shows a front view of the single-row module according to FIG. 1 in various stages of the assembly, FIG. 3 shows the detailed view A of the single-row module according to FIG. 2, FIG. 4 shows the detailed view B of the single-row module according to FIG. 2, and FIG. 5 shows a perspective view of a possible exemplary embodiment of a multi-row module as per the invention for the production of a concrete part.

DETAILED DESCRIPTION OF THE INVENTION

FIGS. 1 to 4 show a possible exemplary embodiment of a single-row module 1*a* for the production of a concrete part. The module 1*a* comprises a row 2 of a plurality of displacement bodies 100 being adjacently arranged in a horizontal longitudinal direction L, which are clamped captively to a grid structure of two individual grids 10, 20 running in the longitudinal direction L, whose grid surfaces are oriented in a transverse or inclined manner in relation to the horizontal. In doing so, each of the grids 10, 20 comprises at least one first and one second longitudinal bar 11, 12 or 21, 22 being arranged at a distance in parallel to one another and running in the longitudinal direction L and a plurality of transverse bars 13, 23 being spaced apart and oriented in a transverse or inclined manner in relation to the horizontal, which are each respectively connected with the longitudinal bars 11, 12 or 21, 22, preferably welded. The longitudinal bars 11, 12 or 21, 22 and transverse bars 13, 23 comprise preferably reinforcing steel and comprise the same diameter. If in the present exemplary embodiment of the inventive single-row module 1*a* according to FIG. 1 only a total of two displacement bodies 100 are shown for reasons of clarity, then this illustration is also representative of modules with more than two displacement bodies in one row. In this respect, the module 1*a* can therefore be extended as needed in the longitudinal direction L. Typically, the modules in the longitudinal direction L can have an extension of up to about 250 cm and comprise in total up to about fourteen adjacently arranged displacement bodies 100.

All displacement bodies 100 comprise at least one first retaining device 311 or 321 and at least one second retaining device 412 or 422 on its outer side for both respective grids 10 or 20, said retaining devices being formed and arranged in relation to one another in such a way that both respective grids 10 or 20 are at least interlockingly and captively secured between the first and second retaining device 311, 312 or 412, 422, by accommodating the first longitudinal bar 11 or 21 in the first retaining device 311 or 321 and accommodating the second longitudinal bar 12 or 22 in the second retaining device 412 or 422, and thereby holding together all displacement bodies 100.

The first retaining devices 311, 321 for the first longitudinal bars 11, 21 of the first and second grid 10, 20 are arranged vertically to the longitudinal direction L on the lower side of the displacement bodies at an interval D1, which is about 185 mm in the present exemplary embodiment. This guarantees that the module 1*a* has a secure position on the typically thereunder arranged (not shown here) reinforcement steel supports, on which the first longitudinal bars 11, 12 are generally directly supported when producing concrete parts. As can be seen specifically from FIGS. 1 and 2, the respective second retaining devices 412, 422 for the second longitudinal bars 12, 22 are arranged on the upper side of the displacement bodies 100 at an interval D2, which is considerably smaller than the interval D1 on the lower side and is only about 50 mm in the present exemplary embodiment. An interval D2 of this magnitude ensures that the module 1*a* is safely accessible at both upper, second longitudinal bars 12, 22 of both grids 10, 20 when producing a concrete part, without there existing the risk that a person could step with their foot directly onto the displacement bodies 100 between the two longitudinal bars 12, 22 and damage these. When viewed in the longitudinal direction L—as shown in FIG. 2—the grid surfaces of the two grids 10, 20 are therefore respectively arranged at an incline to the vertical with an angle $\alpha$ of about 15°.

As can be seen specifically in FIGS. 3 and 4, the first retaining devices 311, 321 are formed on the lower side of the displacement bodies 100 as nuts or groove-like recesses in web extensions, which are arranged transversely to the longitudinal direction L on the outer side of the displacement bodies. Each displacement body 100 comprises respectively two first retaining devices 311 or 321 for each of the longitudinal bars 11 or 21 of the first or second grid 10, 20, which are adjacently arranged in the longitudinal direction L and into which the respective longitudinal bar 11, 21 is simultaneously accommodated. For this purpose, the respective nuts or groove-like recesses of the first retaining devices 311 or 321, which are allocated to one of the longitudinal bars 11 or 21, are aligned in the longitudinal direction L. The depth of the nuts or groove-like recesses and the height of the web extensions are selected such that structurally required coverages (layer thickness of the concrete between reinforcement steel supports and displacement bodies arranged thereon or thereunder) can be complied with. The used second retaining devices 412, 422 on the upper side of the displacement bodies 100 are substantially formed as locking hooks in the present exemplary embodiment, which are also aligned transversely to the longitudinal direction L, in this case vertically to the longitudinal direction L. For each of the longitudinal bars 12, 22, at least one second retaining device 412, 422 being formed as a locking hook is located on the upper side.

In FIG. 2, an advantageous method for producing or assembling a module 1*a* is illustrated among other things. For this purpose, both grids 10, 20 are initially positioned flatly adjacent on an even foundation in parallel to the longitudinal direction L at an interval D1. Thereafter the displacement bodies 100 are arranged adjacently on the grids 10, 20 in the longitudinal direction L such that the nuts or groove-like recesses of the first retaining devices 311 or 321 engage with the first longitudinal bars 11 or 21. Furthermore, both grids 10 or 20 are folded up along the longitudinal axis of the respectively first longitudinal bars 11 or 21 until the respectively second longitudinal bars 12 or 22 engage into the second retaining devices 412 or 422 being formed as locking hooks, for example under temporary flexible deformation of the locking hooks. As can be seen specifically in FIG. 4, the nut or groove-like recess of the first retaining device 311, 321 comprises a circle segment-shaped cross-section profile line, which is preferably adapted to the radius of the longitudinal bars 11, 21 such that the nuts or groove-like recesses serve advantageously as a pivoting bearing for the respectively first longitudinal bars 11, 12. Collectively, the cooperation of the accommodation of the respectively first longitudinal bars 11, 21 with the first retaining devices 311, 321 and the respectively second longitudinal bars 12, 22 with the second retaining devices 412, 422 leads to both grids 10, 20 being interlockingly and captively secured respectively individually to the displacement bodies 100 and thus holding together the entirety of all displacement bodies.

As also seen specifically in FIG. 1, each grid 10, 20 per displacement body 100 each comprises two transverse bars 13 or 23, which are laterally fitted to the relevant displacement body 100, in this case such that the transverse bars 13, 23 secure the displacement bodies 100 against adjustment along the longitudinal direction L. Collectively, each two pairs of transverse bars 13 or 23 and the respectively first and second longitudinal bars 11, 12 or 21, 22 thus define a receiving space each for a displacement body 100, which surrounds or fixes the displacement body 100 to the effect that any raising or slipping of the displacement body within the receiving space can be substantially avoided.

As can be further seen from FIGS. 1 and 2, the displacement bodies 100 in the present exemplary embodiment are all identical and formed mirror-symmetrically parallel to the horizontal (except for the recesses on the upper and lower side) in relation to a level. Therefore, the displacement bodies comprise a plurality of retaining devices on both the lower side and upper side, which are offset transversely to the longitudinal direction L among other things. In this respect, the above described first retaining devices 311 or 321 on the lower side of the displacement body 100 are identical to the further second retaining devices 312 or 322 on its upper side. Similarly, the above described second retaining devices 412 or 422 on the upper side of the displacement body 100 are identical to the two other retaining devices 411 or 421 on its lower side. Hereby, the modularity of the displacement bodies 100 increases as they have no mandatory mounting direction at least regarding the upper and lower side such that the modules can be assembled very quickly and without any elaborate rotating or positioning of the displacement bodies.

Instead of one or both of the above described first and second retaining devices 311, 321 or 412, 422, the further first or further second retaining devices 411, 421 or 312, 322 can be used alternatively to secure the respective grid, wherein the interval between the two longitudinal bars of a grid must be adapted for this as applicable. Hereby it is advantageously achieved that the relevant grid 10, 20 can be secured in various positions transversely to the horizontal on the displacement bodies 100. So for example the two grids 10, 20 with their respective first longitudinal bars 11, 21 can be respectively secured in the first retaining devices 311 and 321 on the lower side of the displacement bodies 100 and with their respective second longitudinal bars 12, 22 to the further second retaining devices 312 and 322 on the upper side of the displacement bodies 100. In this case, the two grid surfaces are aligned parallel to the vertical or vertical to the horizontal.

In addition, the displacement bodies 100 in the present exemplary embodiment are formed as hollow bodies, which are composed of two identical half-shell plastic elements, which can be space-savingly stacked into or onto each other. To produce a displacement body from these elements, no other, complementary element is also required. All displacement bodies 100 are substantially formed as oblate spheroids with oblate upper and lower sides, whereby flat concrete parts can specifically be produced. In addition, all retaining devices are formed as a single piece with the displacement bodies or half-shell elements, for example as a singular injection moulded part.

FIG. 5 shows a possible exemplary embodiment of an inventive multi-row module 1*b*, which is used specifically for the production of thicker concrete parts. The module 1*b* comprises a plurality of stacked rows 2, 3 of a plurality of displacement bodies 100 adjacently arranged in a horizontal longitudinal direction L, which are identical to the displacement bodies 100 in FIG. 1 to 4. The displacement bodies 100 are also clamped captively to a grid structure of two individual grids 10, 20 running in the longitudinal direction L, whose grid surfaces are oriented in a transverse or inclined manner in relation to the horizontal. If in the present exemplary embodiment of the module 1*b* according to FIG. 5 only two rows 2, 3 each with two displacement bodies 100 are shown for reasons of clarity, then this illustration is also representative of modules with more than two rows and/or more than two displacement bodies 100 in one row. In this respect, the module 1*b* can therefore be extended or scaled as needed in the longitudinal direction L and/or in the horizontal direction.

Each of the grids 10, 20 comprises at least one first and one second longitudinal bar 11, 12 or 21, 22 being arranged at a distance in parallel to one another and running in the longitudinal direction L and a plurality of transverse bars 13, 23 being spaced apart and oriented in a transverse or inclined manner in relation to the horizontal, which are each connected respectively with the longitudinal bars 11, 12 or 21, 22, specifically welded. The first longitudinal bars 11, 21 of the two grids 10, 20—similarly to the single-row module 1*a*—are accommodated respectively into the first retaining devices 311, 321 on the lower side of the displacement bodies 100 in the bottom row 2, while the second longitudinal bars 12, 22 are accommodated respectively into the second retaining devices 312, 322 on the upper side of the displacement bodies 100 in the top row 3. This is sufficient to secure both respective grids 10, 20 at least interlockingly and captively between the first retaining devices 311 or 321 and the second retaining devices 312 or 322 such that all displacement bodies 100 are thereby held together as a composite between both grids 10, 20.

To strengthen the composite, the two grids 10, 20 respectively comprise additionally a further first longitudinal bar 11.1 or 21.1 and a further second longitudinal bar 12.1 or 22.1, which are accommodated accordingly in the further first retaining devices 311.1 or 321.1 on the lower side of the displacement bodies 100 of the upper row 3 or in the further second retaining devices 412.1 or 422.1 on the upper side of the displacement bodies 100 of the bottom row 2. With more than two rows, it is similarly feasible that each displacement body respectively in a first retaining device, for example on its lower side, and in a second retaining device, for example on its upper side, interacts with a corresponding first or second longitudinal bar of one of the grids. It is however also feasible to forego all further first and second longitudinal bars and to secure the grid as described above only between the first retaining devices of the bottom row and the second retaining devices of the top row. Specifically it would be feasible to forego the two respectively additional longitudinal bars 11.1, 12.1 or 21.1, 22.1 with the two grids 10, 20 shown in FIG. 5 and to accommodate the respective second longitudinal bars 12, 22 in the further second retaining devices 412 or 422 instead of the retaining devices 312 or 322, with the result that the grids 10, 20 would incline in relation to the vertical. In all these configurations, the multi-row module can be advantageously assembled similarly to the single-row module by folding the grids.

What is claimed is:

1. A module for production of concrete parts, comprising:

a plurality of stacked rows of displacement bodies adjacently arranged in a longitudinal direction (L), which are clamped captively to a grid structure made of first and second individual grids extending in the longitudinal direction (L), each of the rows of displacement bodies being arranged parallel to a horizontal plane;

wherein each displacement body has an upper side and a lower side, the upper and lower sides extending parallel to the horizontal plane, wherein the first and second grids have grid surfaces oriented in a perpendicular or inclined manner relative to the horizontal plane and comprise a first and a second longitudinal bar, arranged at a distance in parallel to one another and running in the longitudinal direction (L), and a plurality of transverse bars arranged at a distance from one another and oriented in a perpendicular or inclined manner relative the horizontal plane and respectively connected with the longitudinal bars, wherein at least one of the displacement bodies in a bottom row of the stacked rows, on its lower side for each of the first and second grids comprises a first retaining device and at least one of the displacement bodies in a top row of the stacked rows, on its upper side comprises a second retaining device, wherein the first and the second retaining devices are formed and arranged relative to one another so that both of the first and second grids are interlockingly and captively secured between the first and the second retaining devices by accommodating the first longitudinal bar in the first retaining device and accommodating the second longitudinal bar in the second retaining device thereby holding together all of the displacement bodies.

2. The module according to claim 1, wherein a plurality of the displacement bodies in the bottom row comprise the first retaining device for the first longitudinal bar of at least one of the first and second grids, or a plurality of displacement bodies in the top row comprise the second retaining device for the second longitudinal bar of at least one of the first and second grids, or both.

3. The module according to claim 2, wherein one or a plurality of displacement bodies in at least one of the top and the bottom rows comprise at least one of the first and the second retaining devices for at least one of the first and second grids and wherein said one of the first and second grids for said at least one of the top and the bottom rows comprises a further first and a further second longitudinal bar.

4. The module according to claim 3, wherein in order to secure at least one of the first and second grids in various positions perpendicular to or inclined towards the horizontal direction (L), the one or plurality of displacement bodies comprise a plurality of first retaining devices, a plurality of second retaining devices or pluralities of both the first and the second retaining devices that are offset to each other transversely to the longitudinal direction (L).

5. The module according to claim 4, wherein at least one of the plurality of first retaining devices, the plurality of second retaining devices or the pluralities of both the first and the second retaining devices are formed as a locking device, and wherein the locking device is formed as any one of a locking hook, a locking recess, a locking nut, a locking groove and a locking clamp.

6. The module according to claim 1, wherein at least one of the first or second retaining devices comprises a nut or groove-like recess extending in the longitudinal direction (L), to accommodate one of the first or second longitudinal bars, and wherein the nut or groove-like recess comprises a contorted, circle segment-shaped cross-sectional profile line.

7. The module according to claim 6, wherein the nut or groove-like recess is formed in a web extension on an outer surface of the at least one of the displacement bodies, which extends transversely to the longitudinal direction (L).

8. The module according to claim 1, wherein at least one of the first or the second retaining devices is formed as a single piece with the displacement bodies.

9. The module according to claim 1, wherein all the displacement bodies are formed as any of the group consisting of:

parallel to the longitudinal direction (L) relative to a vertical level, mirror-symmetrically relative to a horizontal level or both;

as a closed hollow body or as a partially open hollow body with the opening downwardly facing into the module;

of plastic, is formed specifically as a plastic injection moulded part; and of two identical half-body elements.

10. The module according to claim 1, wherein each of the transverse bars extends between each two adjacent displacement bodies in one of the top and bottom rows, at least sectionally, each of the displacement bodies in the longitudinal direction (L) is arranged between each two transverse bars that are fitted specifically to the each of the displacement bodies, or both, such that the transverse bars secure the respective displacement bodies against adjustment along the longitudinal direction (L) and to the side.

11. The module according to claim 5, wherein each of the retaining devices is configured so that the at least one first or second bar is attached to a respective one of the retaining devices via temporary flexible deformation of the respective retaining device.

12. The module according to claim 1, wherein each one of the grids contacts exactly two rows of displacement bodies.

13. A module for a production of concrete parts, comprising:

a row of displacement bodies adjacently arranged in a longitudinal direction (L), the displacement bodies being arranged in a horizontal plane and being clamped captively to a grid structure made of first and second grids extending running in the longitudinal direction (L), wherein each displacement body has an upper side and a lower side, the upper and lower sides extending parallel to the horizontal plane;

wherein the first and the second grids each comprise grid surfaces oriented in a perpendicular or inclined manner relative to the horizontal plane and a first and a second longitudinal bar, arranged at a distance in parallel to one another and running in the longitudinal direction (L), and a plurality of transverse bars arranged at a distance from one another and oriented in a perpendicular or inclined manner relative to the first horizontal plane and respectively connected with the first and the second longitudinal bars, wherein at least one of the displacement bodies comprises at least one first retaining device on the lower side and at least one second retaining device on the upper side, and wherein the at least one first and second retaining devices are formed and arranged in relation to one another so that both of the first and second grids are interlockingly and captively secured between the first and second retaining devices by accommodating the first longitudinal bar in the first retaining device and accommodating the second longitudinal bar in the second retaining device thereby holding together all of the displacement bodies.

14. The module according to claim 13, wherein a plurality of the displacement bodies for at least one of the first and second grids comprise respectively at least one of the first and the second retaining devices for accommodating the relevant first or second longitudinal bar.

15. The module according to claim 13, wherein at least one of the displacement bodies comprises a plurality of first retaining devices, a plurality of second retaining devices or pluralities of both first and second retaining devices adjacently arranged in the longitudinal direction (L), in which the respective first or second longitudinal bar is simultaneously accommodated.

16. The module according to claim 13, wherein with at least one of the displacement bodies, the second retaining device for the one grid of the first and second grids and the second retaining device for the other grid of the first and second grids are arranged together such that an interval (D2) between the respectively accommodated second longitudinal bars does not exceed 75 mm or the first retaining device for the one grid of the first and second grids and the first retaining device for the other grid of the first and second grids are arranged relative to each other such that an interval (D1) between the respectively accommodated first longitudinal bars is at least 75 mm.

17. The module according to claim 13, wherein each one of the grids contacts a single row of displacement bodies.

* * * * *